United States Patent [19]

Turbitt

[11] 4,122,355

[45] Oct. 24, 1978

[54] VEHICLE ENGINE AUTOMATIC RESTART CIRCUIT

[76] Inventor: John J. Turbitt, 53 Byron Blvd., Warwick, R.I. 02888

[21] Appl. No.: 795,750

[22] Filed: May 11, 1977

[51] Int. Cl.[2] ..... F02N 17/00

[52] U.S. Cl. ..... 290/38 C; 290/37 R; 123/179 BG

[58] Field of Search ..... 290/38 C, 38 R, 37 R, 290/37 C, 38 D, 38 B, 38 A; 123/179 G, 179 B, 179 R, 179 BG

[56] References Cited

U.S. PATENT DOCUMENTS

| | | | |
|---|---|---|---|
| 3,015,037 | 12/1961 | Parsons et al. | 123/179 BG |
| 3,154,689 | 10/1964 | Babbenmoyer | 123/179 BG |
| 3,528,522 | 9/1970 | Turke, Jr. | 290/38 C |
| 3,744,467 | 7/1973 | Wagner | 123/179 B |
| 4,006,723 | 2/1977 | Schmidli | 123/179 B |

*Primary Examiner*—Herman J. Hohauser

[57] ABSTRACT

A switching circuit for automatically restarting a vehicle engine upon stalling including a normally open vacuum relay connected to the intake manifold of the engine which closes in response to stalling of the engine to electrically connect the vehicle battery to the cranking solenoid of the engine and to simultaneously cause actuation of a solenoid-operated fuel valve element to admit fuel to the engine to prime it. An auxiliary circuit is provided to maintain the valve closed after the engine restarts to prevent a discontinuity in the fuel supply.

4 Claims, 1 Drawing Figure

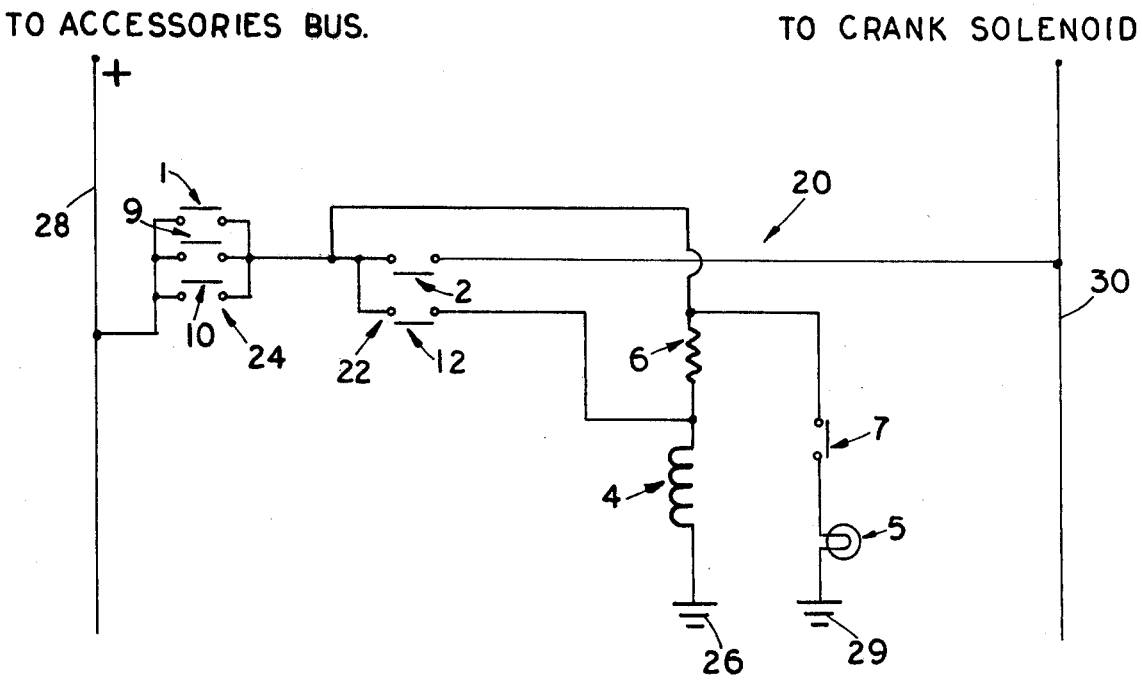
TO ACCESSORIES BUS.
TO CRANK SOLENOID
+
1
9
28
20
2
30
10
24
22
12
6
7
4
5
26
29

VEHICLE ENGINE AUTOMATIC RESTART CIRCUIT

BACKGROUND OF THE INVENTION

This invention relates to a switching circuit, and more particularly, to a switching circuit for instantaneously restarting a vehicle engine upon stalling of the engine.

A dangerous condition occurs when an automotive vehicle equipped with power steering and power brakes stalls. Steering and braking are almost impossible. Accordingly, this invention provides a simple switching circuit for instantaneously and automatically restoring power provided by the vehicle engine upon stalling of the engine by automatically restarting the engine preventing loss of time occasioned by use of a manual ignition switch to restart the vehicle engine, which in turn increases the time that the vehicle may be operating without sufficient steering or braking power.

SUMMARY OF THE INVENTION

In accordance with the invention, the circuit includes the installation of a solenoid-operated three-way valve installed in the vehicle fuel line between the fuel tank and fuel pump, along with a normally open vacuum relay connected to the intake manifold of the engine. Upon stalling of the engine the vacuum relay closes a pair of microswitches in an electric circuit to supplying a positive voltage across the terminals of the engine cranking wolenoid to restart the engine. Simultaneously, the three-way valve in the fuel line is shifted to provide auxiliary fuel from the fuel tank to the engine to prime the engine. The valve and engine remain operating on the auxiliary fuel line until the ignition system is turned off, wherein the components return to their initial, normal operating condition, so that the engine continues to be fed fuel once the vacuum relay reopens upon restart of the engine drawing a vacuum into the intake manifold.

BRIEF DESCRIPTION OF THE DRAWING

Further objects and advantages of the invention will become apparent from the following description and claims, and from the accompanying drawing, wherein:

The sole FIGURE is an electrical schematic diagram of the switching circuit of the present invention.

DETAILED DESCRIPTION OF THE PREFERRED EMBODIMENT

Referring now to the drawing in detail, the venicle engine automatic restart circuit 20 of the present invention includes the installation of a solenoid-operated three-way valve (not shown) having an activating coil 4 in the vehicle fuel line of the automotive vehicle. The valve has alternate inlets connected to the vehicle fuel tank, one inlet furnishing a normal supply of fuel from the tank through an outlet to the fuel pump, and the other inlet (upon actuation of the valve) supplying an emergency supply of fuel to the same outlet. Upon movement of the shiftable valve element, a normally open microswitch 7 is closed by the valve element.

The circuit 20 further includes the installation of a normally open vacuum operated relay 22 in the intake manifold of the engine. When the engine is off a pair of switch contacts 2, 12 of relay 22 are closed, since no vacuum is induced in the engine manifold, but when the engine is activated, contacts 2 and 12 are opened.

As shown in the FIGURE of the drawing, the contact 12 of vacuum relay 22 is connected in series between a three-position switch 24, having contacts 1, 9, and 10 normally closed by the vehicle shift lever, corresponding to the high, low and reverse drive positions of the switch lever, and the coil 4 of the three-way fuel valve. Valve coil 4 is grounded at 26, while switch 24 is connected to the positive or hot lead 28, from the vehicle accessories bus, including the vehicle battery.

A second series circuit is established from lead 28 through contact 2 of vacuum relay 22 to a second lead 30 connected to the cranking solenoid for the vehicle engine.

Finally, a third series circuit is established from lead 28 through switch 24 to a resistor 6 in series with coil 4. Switch 7 and a light 5 grounded at 29 is connected in parallel to resistor 6 and coil 4.

In operation, upon stalling of the vehicle engine, vacuum relay 22 closes, closing contacts 2 and 12 and establishing a series circuit from lead 28 through any of the contacts 1, 9 or 10, of switch 24 depending upon the mode of travel of the vehicle, through contact 2 to lead 30 to the cranking solenoid to immediately restart the engine. Simultaneously, a series circuit is established from lead 28 through switch 24, and contact 12 to coil 4 of the fuel valve to switch to an emergency fuel supply to prime the engine as it is cranked.

Upon restarting of the engine, vacuum relay 22 opens, but coil 4 remains energized from lead 28 through switch 24 and resistor 6, whose value is chosen so as to assure continued activation of coil 4 against a spring return in the valve, to assure adequate fuel to the engine without interruption. Similarly, upon closing of coil 4, switch 7 is closed to light lamp 5, which serves as an indication that the vehicle is operating on the auxiliary switching circuit.

Once the ignition switch is turned off, and shift lever switch 24 opened by the return of the shift lever to neutral or park, coil 4 is deactivated and the ignition circuit returned to normal operation. The three-way fuel valve will return to normal operation by the spring return shifting its inlet to normal supply. Since coil 4 will be activated only where the full potential of the vehicle battery is applied to the coil, e.g. 12 volts, upon restart after the ignition has been turned off, the fuel valve will remain in its normal mode of operation, unless relay 22 closes upon stall of the vehicle.

While a specific embodiment of a vehicle engine automatic restart circuit has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A vehicle engine restart switching circuit comprising:

first lead means adapted to be connected to a cranking solenoid of a vehicle engine, second lead means adapted to be connected to a source of electrical energy in said vehicle, a normally open vacuum relay having a pair of contact elements adapted to close in response to stalling of a vehicle engine, normally open switch means in series with said first lead means, one of said contact elements of said vacuum relay, and said second lead means adapted to be closed in response to forward or reverse movement of said vehicle, whereby upon stalling of said engine said cranking solenoid is electrically connected to said source of electrical energy through said contact elements and switch means, and a solenoid-operated fuel valve element adapted to be located between a vehicle fuel tank and fuel pump having a coil in series with the second contact element of said vacuum relay, whereby upon stalling of said engine said coil is simultaneously activated to supply fuel to said engine to prime the same.

2. The circuit of claim 1 including means between said normally open switch means and said coil for connecting said switch means directly to said coil whereby said coil will remain activated upon opening of said vacuum relay.

3. The circuit of claim 2 wherein said connecting means includes a resistor in series with said coil having a predetermined value.

4. The circuit of claim 3 wherein said connecting means further includes a switch and light in parallel with said resistor and coil, said switch being closed by said fuel valve element upon activation of said coil to provide a visual indication through said light of the closing of said valve and operation of said restart circuit.

* * * * *